US011707666B2

(12) United States Patent
Zhang et al.

(10) Patent No.: US 11,707,666 B2
(45) Date of Patent: Jul. 25, 2023

(54) ADJUSTMENT MECHANISM FOR ELECTRIC POWER-DRIVEN SHOE

(71) Applicant: Shift Robotics, Inc., Pittsburgh, PA (US)

(72) Inventors: Jiancheng Zhang, JiangBei NingBo (CN); Bojie Xu, JiangBei NingBo (CN); Jianjun Li, JiangBei NingBo (CN); Dongliang Song, JiangBei NingBo (CN)

(73) Assignee: Shift Robotics, Inc., Pittsburgh, PA (US)

( * ) Notice: Subject to any disclaimer, the term of this patent is extended or adjusted under 35 U.S.C. 154(b) by 600 days.

(21) Appl. No.: 16/346,858

(22) PCT Filed: Aug. 3, 2017

(86) PCT No.: PCT/CN2017/000500
§ 371 (c)(1),
(2) Date: May 1, 2019

(87) PCT Pub. No.: WO2018/082193
PCT Pub. Date: May 11, 2018

(65) Prior Publication Data

US 2021/0322859 A1 Oct. 21, 2021

(30) Foreign Application Priority Data

Nov. 1, 2016 (CN) ..... 201610937120.3

(51) Int. Cl.
*A63C 17/12* (2006.01)
*A63C 17/02* (2006.01)
*A63C 17/26* (2006.01)

(52) U.S. Cl.
CPC ..... *A63C 17/12* (2013.01); *A63C 17/02* (2013.01); *A63C 17/26* (2013.01)

(58) Field of Classification Search
CPC ..... A63C 17/12; A63C 17/02; A63C 17/26; A63C 17/067; A63C 17/262
(Continued)

(56) References Cited

U.S. PATENT DOCUMENTS 833,100 A 10/1906 Wells
1,672,700 A * 6/1928 Vass ..... A63C 17/02 280/11.31
(Continued)

FOREIGN PATENT DOCUMENTS

CN 2759524 Y 2/2006
CN 201423154 Y 3/2010
(Continued)

OTHER PUBLICATIONS

International Search Report and Written Opinion for PCT/CN2017/000499 dated Oct. 20, 2017.
(Continued)

*Primary Examiner* — Frank B Vanaman
(74) *Attorney, Agent, or Firm* — DLA Piper LLP (US)

(57) ABSTRACT

An adjustment mechanism for an electric power-driven shoe, the mechanism comprising a shoe sole (1) is presented, wherein a plurality of rolling wheels (2) are arranged below the shoe sole (1); a foot-positioning mechanism is arranged above the shoe sole (1) and is provided with an angle-adjusting mechanism for adjusting an angle between the foot-positioning mechanism and a lengthwise direction of the shoe sole (1).

9 Claims, 2 Drawing Sheets

(58) Field of Classification Search
USPC ..... 280/14.24; 180/180, 181
See application file for complete search history.

(56) References Cited

U.S. PATENT DOCUMENTS

| | | | | |
|---|---|---|---|---|
| 1,801,205 | A | 4/1931 | Mirick | |
| 2,857,008 | A | 10/1958 | Pirrello | |
| 3,114,562 | A * | 12/1963 | Goodman | A63C 17/02 280/11.3 |
| 3,392,986 | A | 7/1968 | Ryan | |
| 3,575,412 | A * | 4/1971 | Arsenian | A63B 69/18 482/71 |
| 4,061,348 | A * | 12/1977 | Carter | A63C 17/02 280/11.201 |
| 4,334,690 | A | 6/1982 | Klamer et al. | |
| 4,417,737 | A | 11/1983 | Suroff | |
| 4,553,767 | A | 11/1985 | Robjent et al. | |
| RE32,346 | E | 2/1987 | Klamer et al. | |
| 4,695,071 | A * | 9/1987 | Johnston | B62K 5/023 280/250 |
| 4,932,676 | A | 6/1990 | Klamer | |
| 5,046,746 | A * | 9/1991 | Gierveld | A63C 1/38 280/11.222 |
| 5,056,802 | A | 10/1991 | Piotrowski | |
| 5,236,058 | A | 8/1993 | Yamet et al. | |
| 5,400,484 | A | 3/1995 | Gay | |
| 5,413,380 | A * | 5/1995 | Fernandez | A63C 17/10 280/11.19 |
| 5,452,907 | A * | 9/1995 | Meibock | A43B 5/0466 280/11.231 |
| 5,570,894 | A * | 11/1996 | Brandner | A63C 17/067 280/11.221 |
| 5,730,241 | A | 3/1998 | Shyr et al. | |
| 5,797,466 | A | 8/1998 | Gendle | |
| 6,059,062 | A | 5/2000 | Staelin et al. | |
| 6,116,620 | A * | 9/2000 | Gabrielli | A63C 17/067 280/11.19 |
| 6,322,088 | B1 | 11/2001 | Klamer et al. | |
| 6,425,587 | B1 | 7/2002 | Moon | |
| 6,497,421 | B1 | 12/2002 | Edgerley et al. | |
| 6,517,091 | B1 | 2/2003 | Fisher et al. | |
| 6,645,126 | B1 | 11/2003 | Martin et al. | |
| 7,163,210 | B1 | 1/2007 | Rehkemper et al. | |
| 7,204,330 | B1 | 4/2007 | Lauren | |
| 9,027,690 | B2 | 5/2015 | Chavand | |
| 9,295,302 | B1 | 3/2016 | Reed et al. | |
| 9,925,453 | B1 | 3/2018 | Tuli | |
| 10,456,698 | B2 | 10/2019 | Chen et al. | |
| 10,524,533 | B2 * | 1/2020 | Knoll | A43B 5/1625 |
| 10,709,961 | B2 | 7/2020 | Zhang et al. | |
| 10,933,298 | B2 | 3/2021 | Zhang et al. | |
| 10,933,299 | B2 | 3/2021 | Zhang et al. | |
| 2001/0022433 | A1 | 9/2001 | Chang | |
| 2003/0047893 | A1 | 3/2003 | Pahis | |
| 2003/0141124 | A1 | 7/2003 | Mullet | |
| 2004/0090023 | A1 * | 5/2004 | Crowder | A63C 1/20 280/11.15 |
| 2004/0239056 | A1 | 12/2004 | Cho et al. | |
| 2005/0046139 | A1 | 3/2005 | Guan | |
| 2005/0082099 | A1 | 4/2005 | Tuli | |
| 2006/0027409 | A1 | 2/2006 | Adams et al. | |
| 2007/0090613 | A1 | 4/2007 | Lyden | |
| 2007/0273110 | A1 | 11/2007 | Brunner | |
| 2008/0093144 | A1 | 4/2008 | Manor | |
| 2009/0120705 | A1 | 5/2009 | McKinzie | |
| 2010/0207348 | A1 | 8/2010 | Othman | |
| 2012/0285756 | A1 | 11/2012 | Treadway | |
| 2013/0025955 | A1 | 1/2013 | Chavand | |
| 2013/0123665 | A1 | 5/2013 | Mariani et al. | |
| 2013/0152426 | A1 * | 6/2013 | Lederer | A43B 3/26 36/97 |
| 2013/0226048 | A1 | 8/2013 | Unluhisarcikli et al. | |
| 2013/0274640 | A1 | 10/2013 | Butters et al. | |
| 2013/0282216 | A1 | 10/2013 | Edney | |
| 2014/0196757 | A1 | 7/2014 | Goffer | |
| 2015/0196403 | A1 | 7/2015 | Kim et al. | |
| 2015/0196831 | A1 | 7/2015 | Treadway et al. | |
| 2015/0352430 | A1 | 12/2015 | Treadway et al. | |
| 2016/0045385 | A1 | 2/2016 | Aguirre-Ollinger et al. | |
| 2016/0058326 | A1 | 3/2016 | Winfree et al. | |
| 2016/0113831 | A1 | 4/2016 | Hollander | |
| 2016/0158635 | A1 * | 6/2016 | Aders | A63C 17/014 180/65.1 |
| 2016/0206949 | A1 * | 7/2016 | Murphy | A63C 17/015 |
| 2016/0250094 | A1 | 9/2016 | Amundson et al. | |
| 2016/0331557 | A1 | 11/2016 | Tong et al. | |
| 2017/0055880 | A1 | 3/2017 | Agrawal et al. | |
| 2017/0181917 | A1 | 6/2017 | Ohta et al. | |
| 2017/0182397 | A1 | 6/2017 | Zhang | |
| 2017/0259162 | A1 | 9/2017 | Mo | |
| 2017/0259811 | A1 | 9/2017 | Coulter et al. | |
| 2017/0296116 | A1 | 10/2017 | McCarthy et al. | |
| 2018/0008881 | A1 | 1/2018 | Mo | |
| 2018/0015355 | A1 | 1/2018 | Desberg et al. | |
| 2018/0333080 | A1 | 11/2018 | Malawey et al. | |
| 2019/0061557 | A1 | 2/2019 | Quick et al. | |
| 2019/0184265 | A1 | 6/2019 | Micacchi | |
| 2019/0314710 | A1 | 10/2019 | Zhang et al. | |
| 2019/0351315 | A1 | 11/2019 | Li | |
| 2020/0000373 | A1 | 1/2020 | Agrawal et al. | |
| 2020/0061444 | A1 | 2/2020 | Zhang et al. | |
| 2020/0061445 | A1 | 2/2020 | Zhang et al. | |
| 2020/0129843 | A1 | 4/2020 | Zhang et al. | |
| 2020/0129844 | A1 | 4/2020 | Zhang et al. | |
| 2020/0197786 | A1 | 6/2020 | Artemev | |
| 2021/0015200 | A1 | 1/2021 | Tuli | |

FOREIGN PATENT DOCUMENTS

| | | | |
|---|---|---|---|
| CN | 201565096 | U | 9/2010 |
| CN | 101912680 | A | 12/2010 |
| CN | 101912681 | A | 12/2010 |
| CN | 102167117 | A | 8/2011 |
| CN | 102805928 | A | 12/2012 |
| CN | 203389316 | U | 1/2014 |
| CN | 104689559 | A | 6/2015 |
| CN | 204364838 | U | 6/2015 |
| CN | 204395401 | U | 6/2015 |
| CN | 105214299 | A | 1/2016 |
| CN | 106039689 | A | 10/2016 |
| CN | 205627021 | U | 10/2016 |
| CN | 106390428 | A | 2/2017 |
| CN | 106390430 | A | 2/2017 |
| CN | 106582003 | A | 4/2017 |
| EP | 0686412 | A2 | 12/1995 |
| EP | 0834337 | A2 | 4/1998 |
| EP | 0894515 | A1 | 2/1999 |
| EP | 3629925 | | 4/2020 |
| GB | 2452563 | A | 3/2009 |
| JP | 2005-81038 | A | 3/2005 |
| JP | 2013111118 | A | 6/2013 |
| WO | 2011092443 | A2 | 8/2011 |
| WO | 2018082192 | A1 | 5/2018 |
| WO | 2018082193 | A1 | 5/2018 |
| WO | 2018082194 | A1 | 5/2018 |
| WO | 2018082195 | A1 | 5/2018 |
| WO | 2019014152 | A1 | 1/2019 |
| WO | 2019014154 | A1 | 1/2019 |
| WO | 2019212995 | A1 | 11/2019 |
| WO | 2020146680 | A1 | 7/2020 |

OTHER PUBLICATIONS

International Search Report and Written Opinion for PCT/CN2017/000500 dated Oct. 20, 2017.

International Search Report and Written Opinion for PCT/CN2017/000501 dated Nov. 3, 2017.

International Search Report and Written Opinion for PCT/CN2017/000502 dated Oct. 13, 2017.

International Search Report and Written Opinion for PCT/US2018/041343 dated Sep. 7, 2018.

(56) References Cited

OTHER PUBLICATIONS

International Search Report and Written Opinion for PCT/US2018/041345 dated Sep. 7, 2018.
International Search Report and Written Opinion for PCT/US2019/029742 dated Aug. 26, 2019.
International Search Report and Written Opinion for PCT/US2020/012992 dated Apr. 1, 2020.
Extended European Search Report for EP18831335.7 dated Feb. 3, 2021.
International Search Report and Written Opinion for PCT/US2021/056014 dated Jan. 18, 2022.

* cited by examiner

ADJUSTMENT MECHANISM FOR ELECTRIC POWER-DRIVEN SHOE

CROSS-REFERENCE TO RELATED APPLICATIONS

This application is a U.S. national stage filing under 35 U.S.C. § 371 of International PCT Application No. PCT/CN2017/000500 filed Aug. 3, 2017, and titled "ADJUSTMENT MECHANISM FOR ELECTRIC POWER-DRIVEN SHOE," which in turn claims the priority to Chinese Patent Application No. CN201610937120.3 filed Nov. 1, 2016.

TECHNICAL FIELD

The present application relates to the technical field of transportation tools, and more particularly relates to adjustment mechanisms of electric power shoes.

BACKGROUND ART

With the further growth of the urban population, traffic jam has become the nuisance of every main city. Although public transportation is a very effective solution to the traffic jam, a last kilometer problem, that is, a relatively long final walking distance, still remains, which is one of the factors hindering the building of a perfect bus system. Therefore, there are various electric transportation tools on the market, such as electric roller skates, which are the solutions to the last kilometer problem.

The Chinese invention patent No. CN103263767A discloses transportation electric roller skates, batteries of which are disposed at the bottoms of shoe bodies. Each shoe body is of a three-wheel structure, two wheels at the front end of which are driving wheels and a rear wheel of which is a ground wheel. Forward and backward speeds are adjusted by applying a force to pedals, and the moving directions of the roller skates can be changed by the radial force applied to the ground wheels through left-right swaying.

However, the existing roller skates must be placed in parallel during straight sliding, otherwise, after the roller skates slide a certain distance, a user would fall over easily because the distance between his/her feet becomes farther and farther, or because the distance between the two roller skates becomes closer and closer to cause interference between the two roller skates. However, people have different walking habits, some used to walking in a toe out manner and some used to walking in a toe in manner, so that the two types of people have to do straight sliding in ways to which they are not used all the time, or need to continuously adjust the positions of the roller skates.

SUMMARY OF THE INVENTION

In view of the shortcomings in the prior art, the present application provides adjustment mechanisms of electric power shoes, by which, the relative positions of the shoes may not change even though people do straight sliding in habitual walking ways.

In order to solve the above-mentioned problem, the present application provides the following technical solution: adjustment mechanisms of electric power shoes, each of which includes a shoe sole. A plurality of rollers are disposed below the shoe sole. Each adjustment mechanism is characterized in that a foot locating mechanism is disposed above the shoe sole, and is provided with an angle adjustment mechanism for adjusting an angle between the foot locating mechanism and the lengthwise direction of the shoe sole.

According to the present application, the positions of feet of a human body on the shoe soles are determined through the foot locating mechanisms, and then the placement directions of the feet of the human body on the shoe soles are adjusted through the angle adjustment mechanisms, so that the user can still keep the two shoe soles of the power shoes and the rollers in parallel states even when standing on the shoe soles in his/her own way, toe in or toe out of the two feet, and the two power shoes may not change their relative positions during straight sliding, thus guaranteeing the steadiness of the straight sliding.

Specifically, each of the foot locating mechanisms includes a shoe heel locating member disposed at the rear part of each of the shoe soles. The shoe heel locating member includes a base plate connected to the shoe sole, and block pieces upwards extending from two sides and the rear side of the base plate. A space for accommodating the foot heel is formed among the block pieces. By these structures, the feet of the human body cannot move after being placed between the block pieces, so that the placement angles of the feet on the shoe soles may not change to guarantee the stability of continuous sliding.

Specifically, each of the angle adjustment mechanisms includes at least two slot holes formed in each of the base plates. Extending lines along the lengthwise directions of the two slot holes are intersected, that is to say, a certain included angle is formed between the two slot holes, so that when each of the shoe heel locating members is moved towards two side surfaces, it is inevitable that an angle between the shoe heel locating member and the lengthwise direction of each of the shoe soles deflects to enable the shoe heel locating member to reach a habitual position of the user.

In order to achieve a better technical effect, a further technical measure also includes that: two groups of the above-mentioned slot holes are disposed oppositely, each group including at least two slot holes disposed in parallel. The above-mentioned structure enables the shoe heel locating member to not only adjust its angle from the lengthwise direction of the shoe sole, but also adjust its position in the lengthwise direction of the shoe sole, so that the present application can be suitable for people of different feet lengths.

Further, a motor is further disposed at the lower part of each of the shoe soles. The output end of the motor is connected with a transmission device which is in driving connection with the rollers. By the adoption of this solution, people save more strength during sliding. In addition, in this state, the straight sliding time and distance will be prolonged. The angle adjustment mechanisms save more strength for sliding and make the sliding stabler.

A further improvement is that: each of the shoe soles consists of a shoe heel part and a shoe forefoot part. The shoe heel part and the shoe forefoot part are hinged with each other. As the shoe heel part and the shoe forefoot part may rotate relatively, the present application is more in line with the normal walking habit of the human body.

Further, six rollers are provided, four of which are disposed on the shoe heel part, and the other two of which are disposed on the shoe forefoot part. The above-mentioned structure can ensure that the user can keep stable when walking in this present application by treading on the ground no matter with foot heels or foot soles.

Compared with the prior art, the present application has the following beneficial effects that: the positions of the feet of the human body on the shoe soles are determined through the foot locating mechanisms, and then the placement directions of the feet of the human body on the shoe soles are adjusted through the angle adjustment mechanisms, so that the user can still keep the two shoe soles of the power shoes and the rollers in parallel states even when standing on the shoe soles in his/her own way, toe in or toe out of the two feet, and the two power shoes may not change their relative positions during straight sliding, thus guaranteeing the steadiness of the straight sliding.

DETAILED DESCRIPTION OF THE INVENTION

A further detailed description will be made below to the present application in combination with accompanying drawings and specific implementation modes.

Embodiment 1

Figure 1:
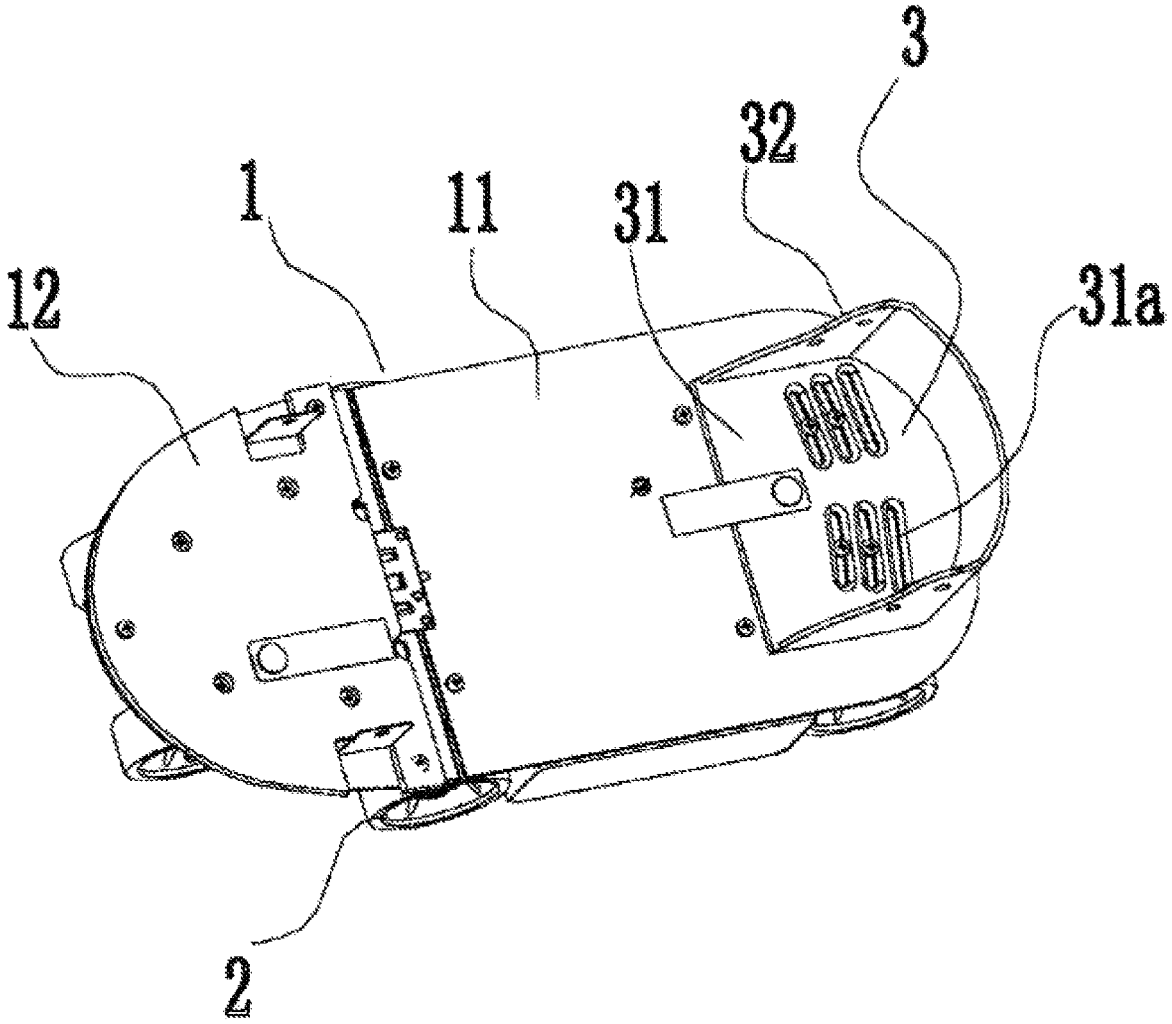
FIG. 1 is a schematic diagram of a vamp structure of the embodiment of the present application.
Figure 2:
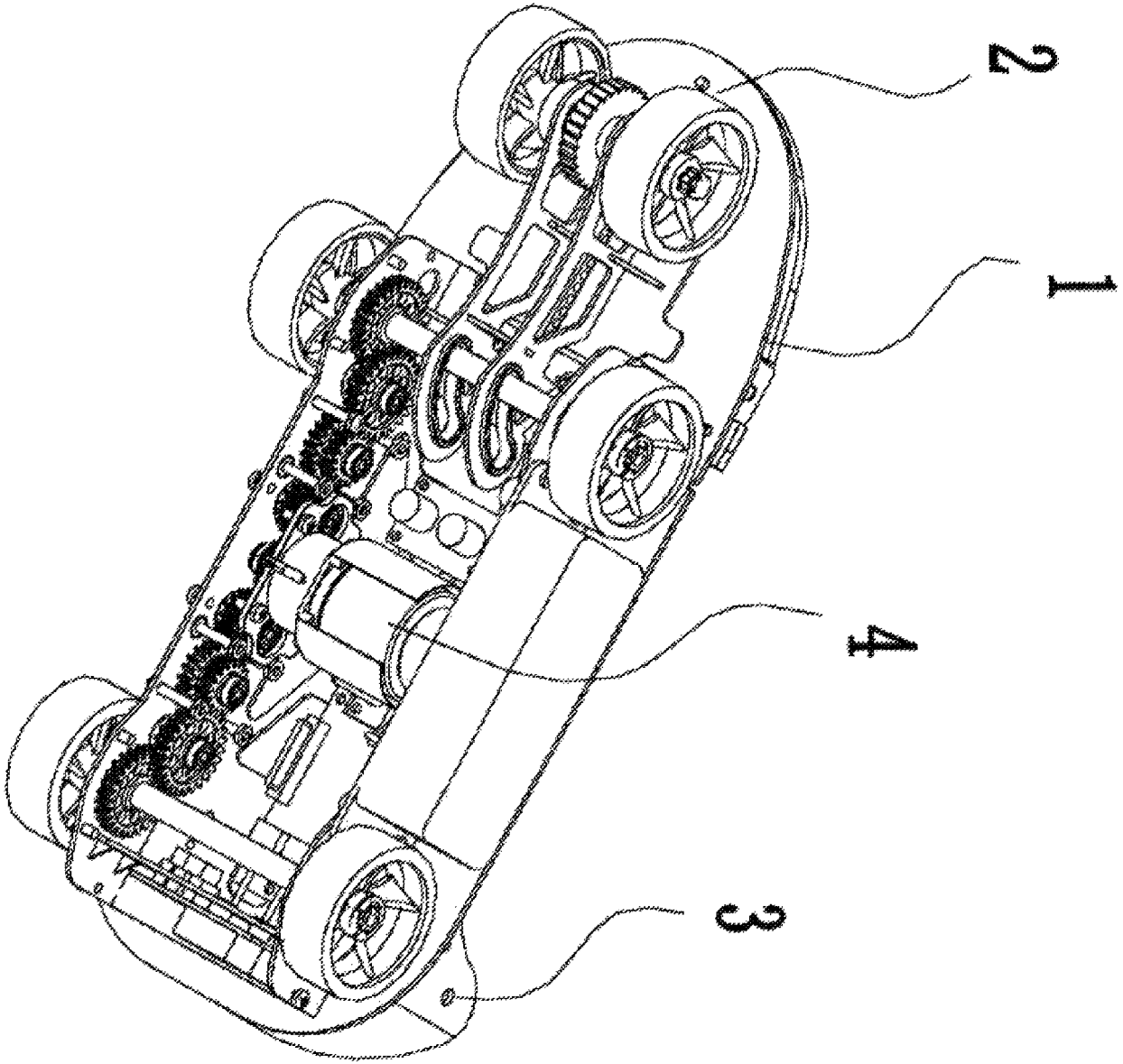
FIG. 2 is a schematic diagram of a shoe sole structure of the embodiment of the present application.

With reference to FIG. 1, adjustment mechanisms of electric power shoes are provided, each of which includes a shoe sole 1. A plurality of rollers 2 are disposed below the shoe sole 1. Each adjustment mechanism is characterized in that a foot locating mechanism is disposed above the shoe sole 1, and is provided with an angle adjustment mechanism for adjusting an angle between the foot locating mechanism and the lengthwise direction of the shoe sole 1.

In this embodiment, the foot locating mechanism includes a shoe heel locating member 3 disposed at the rear part of the shoe sole 1. The shoe heel locating member 3 includes a base plate 31 connected to the shoe sole 1 and block pieces 32 upwards extending from two sides and the rear side of the base plate 31. A space for accommodating the foot heel is formed among the block pieces 32.

The angle adjustment mechanism includes two groups of oppositely disposed slot holes 31*a* formed in the base plate 31. Extending lines along the lengthwise directions of the slot holes 31*a* are intersected. Each group of slot holes 31*a* includes at least three slot holes 31*a* disposed in parallel. Screws pass through the slot holes 31*a*, and then fix the foot locating mechanism on the shoe sole 1.

In addition, a motor 4 is further disposed at the lower part of the shoe sole 1. The output end of the motor 4 is connected with a transmission device which is in driving connection with the rollers 2.

The shoe sole 1 consists of a shoe heel part 11 and a shoe forefoot part 12. The shoe heel part 11 and the shoe forefoot part 12 are hinged with each other. Six rollers 2 are provided, four of which are disposed on the shoe heel part 11, and the other two of which are disposed on the shoe forefoot part 12.

When using this present application, the user firstly adjusts the angles between the foot locating mechanisms and the lengthwise directions of the shoe soles according to their habits, and then fixes the foot locating mechanisms. After putting on the present application, the user can walk in their habitual walking ways. As the present application accords with the walking habit of the user, the user can master the use of the present application easily without too much roller skating experience. If the user wants to take a rest, he/she can let the shoes slide automatically. During sliding, the feet of the user still can be kept in postures of his/her own habit.

Of course, in addition to the implementation mode mentioned in this embodiment, the angle adjustment mechanisms may also have other implementation modes. For example, the slot holes may be formed in the shoe soles, and the lower side surfaces of the foot locating mechanisms are provided with pin shafts inserted into the slot holes. Or, the foot locating mechanisms are detachably mounted on the shoe soles, and a plurality of mounting positions for fixing the angle directions are disposed on the shoe soles.

The locating mechanisms may also have other implementation modes in addition to the implementation solution mentioned in this implementation mode. For example, the most common locating mechanisms are shaped like shoes.

The invention claimed is:

1. An adjustment mechanism for electric power shoes, the mechanism comprising:

a shoe sole, wherein the shoe sole comprises a shoe heel part and a shoe forefront part, wherein the shoe heel part and the shoe forefoot part are rotatably hinged together;

a plurality of rollers disposed below the shoe sole; and a foot locating mechanism, comprising a base plate, disposed above the shoe heel part, wherein the foot locating mechanism comprises an angle adjustment mechanism configured to adjust an angle between the foot locating mechanism and the shoe sole along a lengthwise direction, and wherein the base plate is configured to accommodate a heel of a wearer.

2. The adjustment mechanism of claim 1, wherein the foot locating mechanism further comprises a shoe heel locating member disposed at a rear part of the shoe sole, wherein the base plate is connected to block pieces extending upwards from two sides and a rear side of the base plate, and wherein the block pieces are configured to form a space for accommodating the heel of a wearer.

3. The adjustment mechanism of claim 1, wherein the base plate comprises at least two slot holes formed in the base plate.

4. The adjustment mechanism of claim 3, wherein each of the at least two slot holes are configured to receive a fastener to attach the foot locating mechanism to the shoe sole.

5. The adjustment mechanism of claim 3, wherein the at least two slot holes comprise a first group of slot holes and a second group of slot holes, wherein the first group of slot holes and the second group of slot holes are disposed crosswise in the base plate, wherein slot holes within each of the first group and the second group are parallel with respect to other slot holes in the respective group, and wherein slot holes in the first group of slot holes are nonparallel with respect to slot holes in the second group of slot holes.

6. The adjustment mechanism of claim 1, wherein the plurality of rollers comprise six rollers, and wherein four rollers of the plurality rollers are disposed on the shoe heel part and two rollers of the plurality of rollers are disposed on the shoe forefoot part.

7. The adjustment mechanism of claim 1, further comprising a motor disposed at a lower part of the shoe sole, wherein the motor is connected with a transmission device in driving connection with at least one of a plurality of rollers.

8. The adjustment mechanism of claim 7, wherein the shoe heel part and the shoe forefoot part are hinged together.

9. The adjustment mechanism of claim 8, wherein the plurality of rollers comprise six rollers, and wherein four rollers of the plurality rollers are disposed on the shoe heel part and two rollers of the plurality of rollers are disposed on the shoe forefoot part.

* * * * *